US005535955A

United States Patent [19]

Enger et al.

[11] Patent Number: 5,535,955

[45] Date of Patent: Jul. 16, 1996

[54] APPARATUS FOR SELECTIVELY PLACING YARN RESERVE WINDINGS ON OPPOSITE ENDS OF A YARN TUBE

[75] Inventors: Jurgen Enger, Monchengladbach; Josef Bertrams, Wegberg; Bernhard Schmitz, Willich; Hermann-Josef Vest, Monchengladbach, all of Germany

[73] Assignee: W. Schlafhorst AG & Co., Moenchengladbach, Germany

[21] Appl. No.: 270,387

[22] Filed: Jul. 5, 1994

[30] Foreign Application Priority Data

Jul. 12, 1993 [DE] Germany ..... 9310332.8 U

[51] Int. Cl.[6] ..... B65H 54/38; B65H 49/00

[52] U.S. Cl. ..... 242/18.0 PW; 242/129.510; 242/578.100; 242/586.100; 242/596.400; 242/596.600

[58] Field of Search ..... 242/18 PW, 129.51, 242/129.53, 578.1, 596.6, 596.4, 586.1

[56] References Cited

U.S. PATENT DOCUMENTS

| | | | |
|---|---|---|---|
| 2,523,806 | 9/1950 | Bohne | 242/129.51 |
| 2,575,062 | 11/1951 | Merwin | 242/596.6 |
| 4,284,995 | 8/1981 | Gordon | 242/129.51 |
| 4,483,493 | 11/1984 | Schonmeier | 242/596.6 X |
| 4,676,449 | 6/1987 | Buttermann | 242/596.6 X |
| 4,798,346 | 1/1989 | Myer | 242/18 PW |
| 4,821,974 | 4/1989 | Poehlein | 242/596.4 |
| 4,878,629 | 11/1989 | Grecksch et al. | 242/18 PW |
| 4,911,375 | 3/1990 | Knop | 242/596.6 |
| 5,169,084 | 12/1992 | Potter | 242/596.6 |

*Primary Examiner*—William Stryjewski
*Attorney, Agent, or Firm*—Shefte, Pinckney & Sawyer

[57] ABSTRACT

An apparatus for automatically forming yarn reserve windings selectively on either end of an empty tube prior to winding a yarn package thereon utilizes a threaded spindle and spindle nut assembly for supporting one of a pair of tube clamping plates for selective longitudinal displacement of a tube clamped therebetween during rotation of the tube to place the yarn reserve windings thereon. The hand of the threaded connection between the spindle and spindle nut determines the longitudinal direction in which the tube is displaced and, in turn, determines the end of the tube about which reserve windings are to be formed. In one embodiment, the spindle and spindle nut assembly are exchangeable for a like assembly formed with opposite threads, thereby to alter the longitudinal direction of tube displacement. In another embodiment, an interiorly and exteriorly threaded bushing is interposed between the spindle and the spindle nut, to form oppositely mating threads between the bushing and the spindle and between the bushing and the nut. Set screws are provided to selectively fix the nut with respect to the bushing or, alternatively, to fix the spindle with respect to the bushing, thereby to change the longitudinal direction of tube displacement without necessitating an exchange of the spindle and nut assembly.

11 Claims, 7 Drawing Sheets

APPARATUS FOR SELECTIVELY PLACING YARN RESERVE WINDINGS ON OPPOSITE ENDS OF A YARN TUBE

FIELD OF THE INVENTION

The present invention relates to an apparatus or device for automatic winding of a yarn reserve on an empty tube prior to winding the following extent of the yarn about the tube into a yarn package in the form of a bobbin. More particularly, the present invention relates to such a device or apparatus wherein, for winding the yarn reserve, the tube is located in a tube holding device and is disposed to be displaceable in respect to the fed-in yarn.

BACKGROUND OF THE INVENTION

To facilitate the further processing and handling of yarn cheeses and like bobbins, it is helpful during original winding formation of the bobbin or cheese to initially place a few windings of the leading end of the yarn on the tube apart from the main body of the yarn package to serve as a reserve of yarn before the main body of the yarn package is wound on the tube. These so-called foot windings or foot reserves are formed at a foot end of the tube to be used, for example, to connect the end of the cheese when running out in a creel with the start of a replacement cheese or bobbin, so that a continuous delivery of yarn from the cheeses in the creel is accomplished. Depending on the intended use of the cheese or bobbin, it is important to pull the yarn off the creel in accordance with its twist either as a left-wound or a right-wound yarn. In the production of twisted yarns, the direction of running of the yarn in accordance with the yarn twist is also important. Depending on the intended use of the yarn, it must therefore be wound on the tube either with a right-hand or a left-hand winding in accordance with its twist. For example, with a right-hand winding on a conical cheese or bobbin, the greater diameter of the yarn package is on the right end of the tube, while with left-hand winding on a conical bobbin the greater diameter lies on the left end of the tube, as viewed in the direction of the winding station. Since with a conical cheese or bobbin the yarn is always drawn off over the end having the smaller diameter, the yarn reserve is always located on the end of the conical tube with the larger diameter. Accordingly, with a right-hand winding, the yarn reserve is located on the right end of the cheese forming the foot end, while, with a left-hand winding, it is wound on the left foot end of the tube of the cheese.

As a rule, the winding stations of textile machines and their bobbin change devices, whether of a dedicated winding frame or of the winding device of a spinning machine, are exclusively designed for winding a yarn reserve on one end of a tube. Thus, for example, in case a winding device is converted from right-hand winding to left-hand winding, a conversion of the device for winding the yarn reserve in the form of foot windings on the empty tube is not possible as a rule if the deposit system of the yarn for forming the yarn reserve consists of a displaceable yarn guide.

A device for forming a yarn reserve on an empty tube is known from the prior art, for example Swiss Patent 513 763. Formation of the yarn reserve takes place by displacing an empty tube with respect to a yarn supplied at a constant position. However, this device is able to deposit a yarn reserve only on one end of the tube.

SUMMARY OF THE INVENTION

It is accordingly an object of the present invention to provide a device by which foot windings may be selectively formed as yarn reserves on the right end as well as on the left end of an empty tube.

As in the prior art described above, the yarn reserve is also formed in the present invention by displacing the tube in relation to the fed-in yarn. However, in contrast to the prior art, the deposit of the yarn reserve windings on either end of a tube is possible. The tube is supported during winding in a tube holding device which is adapted to displace the tube longitudinally in relationship to the direction of rotation of the tube.

The displacement of the tube in the tube holding device is performed by means of a threaded spindle seated in the holder for receiving the tube and attached to a tube clamping plate for holding the tube. This threaded spindle is changeable and the direction in which the yarn is deposited on the tube is determined by the direction of the turn of the helix of the threaded spindle. Thus, the direction of the turn of the helix of the threaded spindle differs depending on whether the foot winding is intended to be wound on the right end or the left end of the tube. The threaded spindle can be driven and a uniform displacement of the tube is accomplished because of the screw thread, which allows the uniform deposit of the thread on the tube to form a foot reserve.

Thus, the longitudinal displacement of the tube has a fixed relationship to the direction of its rotation and is a function of the lead of the screw thread. When exchanging one threaded spindle for another threaded spindle with an opposite direction of turn of the helix it is also necessary to change the spindle nut, which is non-rotatably seated in the tube holder. For example, deposit of the yarn on the right end of the tube is possible with a spindle/nut system with a left-handed thread, while with a spindle/nut system with a right-handed thread it is possible to deposit the yarn on the left end of the tube.

In one embodiment, when changing the location at which the yarn reserve is deposited on the tube, the replacement of a threaded spindle is necessary because, although the direction of displacement of the tube could be changed simply by screwing the threaded spindle in or out, the rotational direction of the tube would also be changed. In a change of the direction of displacement of the tube, the direction of rotation of the tube must be maintained, because the fed-in yarn must be wound in the direction of rotation of the tube.

In order to simplify the exchange of a threaded spindle for a threaded spindle with an opposite direction of turn of the helix, the spindle nut is replaceably seated in a holder component of the tube holding device. In the course of the conversion of the machine, for example from a right-hand winding of the foot reserve to a left-hand winding of the foot reserve, the entire spindle/nut system can be exchanged.

In another embodiment of the invention, the threaded spindle is seated in a threaded bushing, and the threaded bushing is seated in the spindle nut which, in turn, is seated in a holder component of the tube holding device for receiving the tube. The screw threads between the threaded spindle and the threaded bushing has an opposite direction of turn from the screw threads between the threaded bushing and the spindle nut. For changing the direction of yarn deposit, either the threaded bushing is fixedly attached to the threaded spindle or the threaded bushing is fixed in the spindle nut. In this way only the respectively connected components are rotatable in relation to the other component. Because of this design of the invention it is unnecessary to exchange the complete threaded spindle/nut system. Winding of the foot reserve either on the right or the left end of the tube is possible by the alternate fixation of the threaded bushing, either to the spindle or the spindle nut. For example, if the threaded spindle has a left-hand screw thread with respect to the threaded bushing and the threaded bushing has a right-hand screw thread with respect to the spindle nut, the right-hand screw thread will be blocked and the left-hand screw thread will be released when the rotation of the threaded bushing in respect to the spindle nut is blocked and the threaded spindle is released in respect to the threaded bushing. As a result, it is only possible to actuate the left-hand screw thread and thus the spindle is displaced toward the left when being turned. In this manner, the deposit of the yarn reserve on the right side of the tube is possible.

If, however, the threaded spindle is connected with the threaded bushing and the threaded bushing is released with respect to the spindle nut, the right-hand screw thread is released. As a result, it becomes possible to deposit the yarn reserve on the left end of the tube, since the tube will be displaced to the right when the threaded spindle is turned.

When the threaded spindle as well as the spindle nut are exchanged for changing the thread lead, it is possible to vary the distance between the yarn windings on the tube in relation to the yarn count, i.e., the yarn size. As will be understood, with fine yarns the yarn windings on the tube are closer together than with coarse yarns. This fact can be taken into account by the selection of an appropriate lead.

According to another aspect of the invention, the spindle nut with the threaded spindle seated therein is seated displaceably in relation to the holder. In this manner, it is possible to open and close the tube plate which is connected with the threaded spindle for exchanging the tubes by a simple displacement of the spindle nut. For example, for this purpose the spindle nut may be supported with respect to the holder on a spring which is tightened when the tube plate is opened and which automatically comes to rest against the inserted tube when the spindle nut is released.

DETAILED DESCRIPTION OF THE PREFERRED EMBODIMENT

Figure 1:
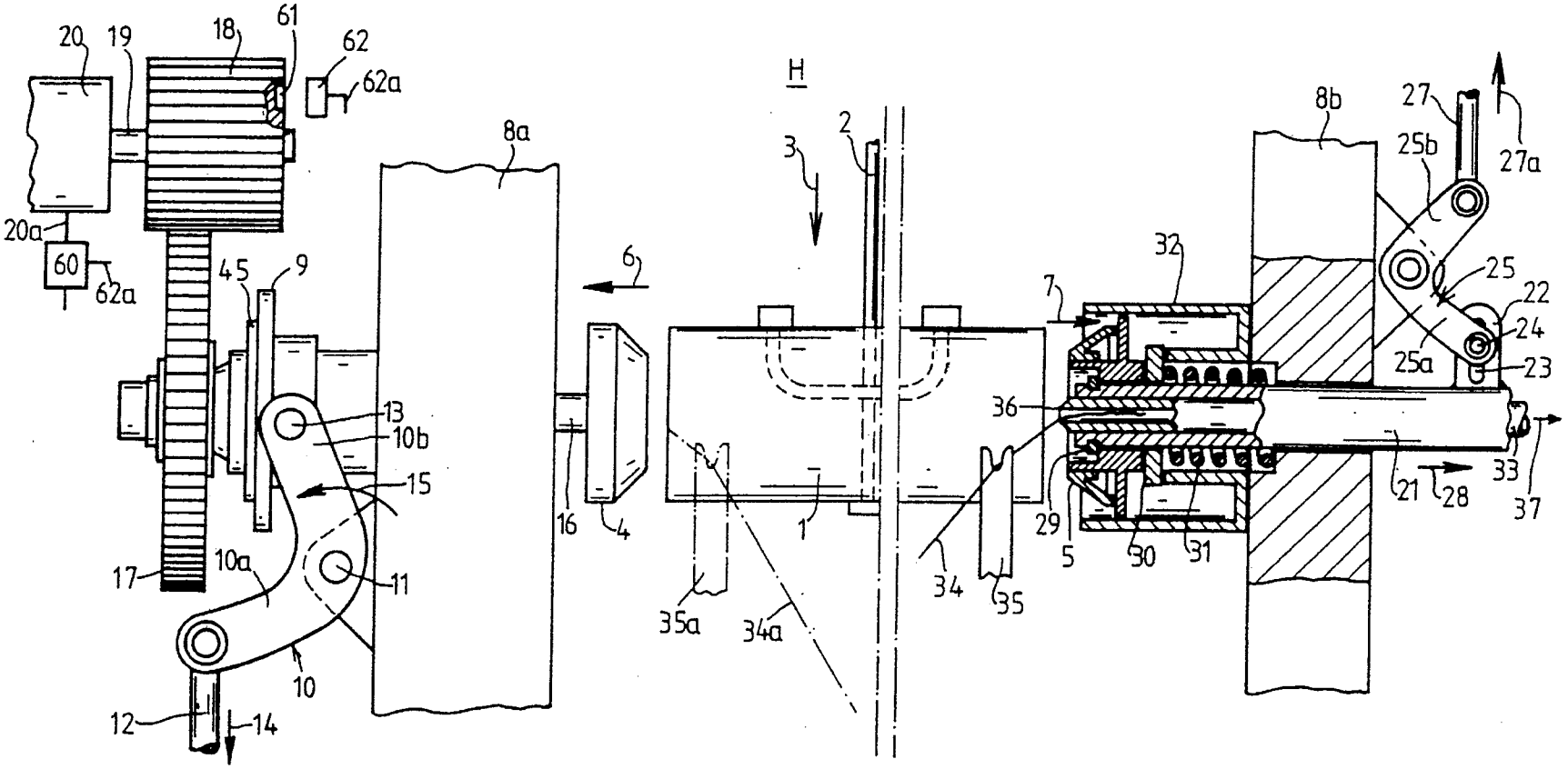
FIG. 1 is a front elevational view, partially sectioned, which shows the insertion of an empty tube in a device according to one preferred embodiment of the present invention.

FIG. 1 is a schematic representation of one preferred embodiment of the device of the present invention adapted for the automatic winding of a yarn reserve on a bobbin tube. Such a device can be employed with spinning machines as well as with winding frames in those cases in which, prior to winding a cheese or bobbin, a series of yarn reserve windings are formed on the still empty tube as the so-called foot reserve. The devices can be disposed on every one of the winding stations of textile machines. However, as a rule this device will be disposed on a single service arrangement serving all of the individual work stations. The cheese or bobbin changer, for example, which inserts an empty replacement tube at the respective winding location following the removal of a completed bobbin or cheese, could be such a service arrangement. The yarn reserve can be wound at the cheese changer prior to inserting the empty tube.

In FIG. 1 an empty tube 1 is just being deposited into the tube holder device H of the device of the invention by a gripper 2, as indicated by the arrow 3. For this purpose the tube retaining plates of the holder H, namely the left tube clamping plate 4 and the right tube clamping plate 5, have been retracted respectively to the left and the right out of their tube holding position, as indicated by the arrows 6,7. The tube clamping plates are seated in the holder H, of which only the elements 8*a*, 8*b* which support the tube clamping plates are indicated here. Retraction of the tube clamping plate 4 is accomplished by means of a thrust bushing 9 which is engaged by an actuator 10 pivotably seated in a joint 11 on the holder element 8*a*. A connecting rod 12 engages the actuator leg 10*a*, and an actuating cam 13 for the thrust bushing 9 is seated on the actuator leg 10*b*. When the connecting rod 12 is actuated in the direction 14, the actuator 10 pivots around the joint 11 in the direction of the arrow 15, causing the thrust bushing 9 to be displaced in the direction 6 by means of the actuating cam 13, thereby opening the tube clamping plate 4 in this manner for inserting or removing a tube 1.

The outwardly extending end of the shaft 16 of the tube clamping plate 4 supports a gear wheel 17 which meshes with a pinion gear 18 fixed on the drive shaft 19 of a motor 20. The gear wheel 17 and, in turn, the shaft 16 and the tube clamping plate 4 are driven by the motor 20 via the pinion gear 18 for turning the tube and thus for winding a yarn reserve.

The other tube clamping plate 5 is rotatably and displaceably seated via a locking ring 29 on a hollow connecting rod 21 which, in turn, is displaceably seated in the holder element 8*b*. A bracket 22 with an elongated slot 23 is fastened to the connecting rod 21 at the side of the holder element 8*b* facing away from the tube clamping plate 5. A pin 24 of an actuator 25 is engaged in the elongated slot 23. The actuator 25 is of an angular configuration, comparable to the actuator 10, and is pivotably seated on the holder element 8*b* at the central intersection 26 of the actuator legs 25*a*,25*b*. While the leg 25*a* supports the pin 24 which engages the elongated slot 23, a connecting rod 27 is attached to the leg 25*b*. As shown, movement of the rod 27 in the direction of the arrow 27*a* pivots the actuator 25 and thereby pulls the connecting rod 21 through the holder element 8*b* in the direction 28 and, in turn, the tube clamping plate 5 moves in the direction 7 with the connecting rod 21 via the locking ring 29.

During such movement, the tube clamping plate 5 acts on a ring 30 to compress a coil spring 31 disposed between the plate 5 and the holder element 8*b*. Upon release of the connecting rod 27, the spring 31 relaxes and pushes the connecting rod 21 back into its inward position causing the empty tube 1 to be grasped by the tube clamping plate 5 and clamped between the tube clamping plates 4,5. Because the possible travel of the connecting rod 21 is a little longer than the distance by which the tube clamping plate 5 can be pushed by the spring 31 on account of the tube 1, the tube clamping plate 5 comes to rest against the empty tube 1 under the biasing force of the spring 31. During retraction of the plate 5, a sleeve 32 encircles the pressure spring 31 and the tube clamping plate 5.

The connecting rod 21 for opening the tube clamping plate 5 is tubular in shape and has a displaceable suction tube 33 extending through its interior. This suction tube is used for aspirating the yarn prior to the deposit of the yarn at the beginning of winding, as illustrated in FIG. 1 by the yarn 34. For this purpose, it is displaceable in respect to the connecting rod 21 by an actuating device (not shown).

Figure 2:
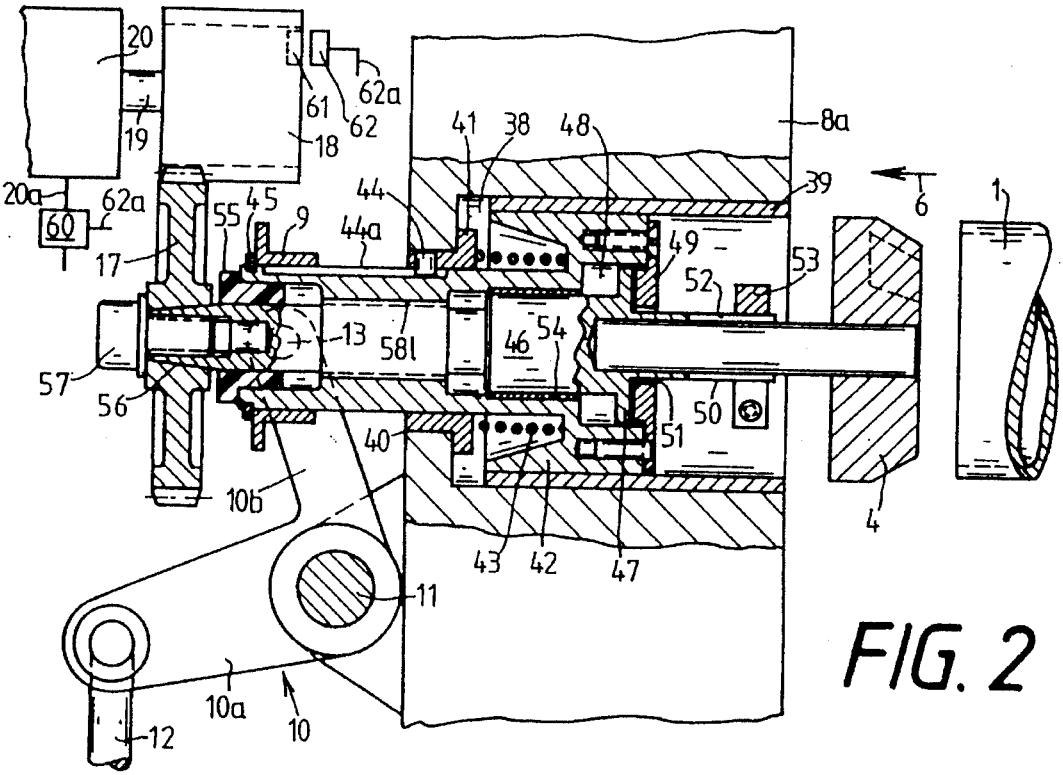
FIG. 2 a cross-sectional view of the device of FIG. 1, showing the seating of the threaded spindle in the holder for the tube when an empty tube is received.

If the connecting rods 12,27 are released, the tube clamping plate 5 is pressed against the tube 1 by the spring force of the spring 31, and the tube clamping plate 4 by a similar spring, shown at 43 in FIG. 2 but not shown in FIG. 1. The tube clamping plates engage in the opposite ends of the empty tube 1 and hold it, so that the gripper 2 can be retracted. In the course of this gripping action, the yarn 34 previously aspirated into the suction tube 33 is clamped between the end rim of the tube 1 and the tube clamping plate 5.

In the present exemplary embodiment, it is intended to deposit a yarn reserve on the rightward end of the tube as viewed in FIG. 1. For this purpose the yarn 34 has been guided by a yarn guide element 35 into a spaced relation from the rightward end of the tube rim from which the winding of the yarn reserve is to take place. The yarn has been aspirated into the suction tube 33 by suction air which is present at the mouth 36 of the suction tube 33. The suction air present is symbolized by the arrow 37.

If it is intended to deposit a yarn reserve on the left side of the tube, the yarn 34*a*, represented here by a broken line, must be positioned by the guide 35*a* at the left side of the tube and clamped there between the tube clamping plate 4 and the leftward end rim of the tube. For this purpose, the yarn is brought to the left end of the tube by manipulating elements (not shown) for introduction into the yarn guide which is also moved into a leftward position 35*a* as shown in broken lines.

The seating of the tube clamping plate 4 is shown in detail in FIG. 2 wherein the illustrated position of the tube clamping plate 4 corresponds to its position shown in FIG. 1, i.e., the tube clamping plate 4 having been retracted by the actuator 10 such that the empty tube 1 can be inserted. The element 8*a* of the tube holder is formed with a recess 38 which is lined with a slide bushing 39. A bore 40 extends outwardly through the holder element 8*a* from the center of the recess 38 and is also fitted with a slide bushing 41. A head portion of a spindle nut 42 glides within the slide bushing 39 in the recess 38 and a coil spring 43 is located between the slide bushing 41 and the facing end of the spindle nut 42 gliding in the slide bushing 39. A cylindrical portion of the spindle nut 42 projects outwardly through the bore 40. A pin 44 is located in the slide bushing 41 and engages in an axial groove 44*a* in the cylindrical portion of the spindle nut 42 to secure the spindle nut 42 against rotation or twisting within the bushing 39.

The thrust bushing 9 encircles the cylindrical portion of the spindle nut 42 which projects outwardly through the bore 40 from the holder element 8*a*. The bearing 9 is kept from slipping off the spindle nut 42 by means of a locking ring 45 secured to the extending end of the spindle nut 42. The actuating cams 13, one of which is shown in broken lines, engage the thrust bushing 9. In the position of the tube clamping plate 4 illustrated in FIGS. 1 and 2, it can be seen that the spindle nut 42 is thereby pulled to the left, corresponding to the directional arrow 6. As a result, the head portion of the spindle nut 42 moving in the slide bushing 39 pushes against the pressure spring 43 and compresses it.

A threaded spindle 46 is rotatably seated in the displaceably disposed spindle nut 42. At the front end of the spindle 46, i.e., its end facing the tube clamping plate 4, the spindle 46 has a collar portion 47 which slides in a recess 48 in the head portion of the spindle nut 42. The recess 48 is closed by a removable abutment disk 49. The travel of the collar portion 47 within the recess 48 can be limited by the thickness of the abutment disk. A tubular element 50 is connected with the collar 47 and extends forwardly through the opening 51 of the abutment disk 49. A clamping slit 52 is formed lengthwise in the element 50. The shaft 16 of the tube clamping plate 4 is inserted through the tubular element 50 and a clamp 53 clamps the shaft 16 of the tube clamping plate 4 in the tubular element 50 and in this manner rigidly connects the tube clamping plate 4 with the threaded spindle 46.

The threaded spindle 46 is rotatably and displaceably seated inside the spindle nut 42 within a bushing 54 disposed within the head portion of the spindle nut 42. The opposite outward end of the spindle 46 is further seated in a plastic bushing 55 at the outer end of the spindle nut 42. The gear wheel 17 is secured by a retaining screw 57 to a conical end portion 56 of the spindle nut 42. By loosening the screw 57, pulling the gear wheel 17 off the conical portion 56 of the spindle nut and removing the locking ring 45, the spindle nut 42 and the threaded spindle 46 can be removed as a unit from the holder element 8*a* and replaced.

The most important aspect of the assembly of the spindle nut 42 and threaded spindle 46 are their mating screw threads 58*l* or 58*r* in that the direction of turn of the helix of the screw thread 58*l* or 58*r* of the threaded spindle 46 determines whether the yarn reserve windings will be placed on the left end or the right end of the empty tube 1. Specifically, if a yarn reserve is to be deposited on the right end of the tube 1, as represented in the present exemplary embodiment of FIGS. 1 and 2, the screw thread is a left-hand screw thread 58*l*. However, if the yarn reserve is to be deposited on the left end of the tube, the screw thread is a right-hand screw thread 58*r*.

These two screw threads with opposite direction turns are necessary for depositing the yarn reserve on the opposite ends of the tube, since during any winding of a yarn reserve, regardless of the tube end to receive the reserve windings, the tube must always maintain the same direction of rotation in order to accomplish proper winding of the yarn. However, the lengthwise displacement of the tube must take place in respectively opposite directions to accomplish placement of reserve windings at opposite ends of the tube.

As can be seen in FIG. 2, the present device is shown to have been prepared for depositing reserve yarn windings on the right end of the tube 1. The collar portion 47 of the threaded spindle 46 is disposed forwardly in the recess 48 in abutment with the abutment disk 49 by which a defined starting position of the threaded spindle 46 is established. The collar portion 47 can now only move to the left within the recess 48, corresponding to the direction of the arrow 6. As will be understood, if the yarn is to be deposited on the right end of the tube while the yarn supply is stationary, the tube must also be moved to the left.

Figure 3:
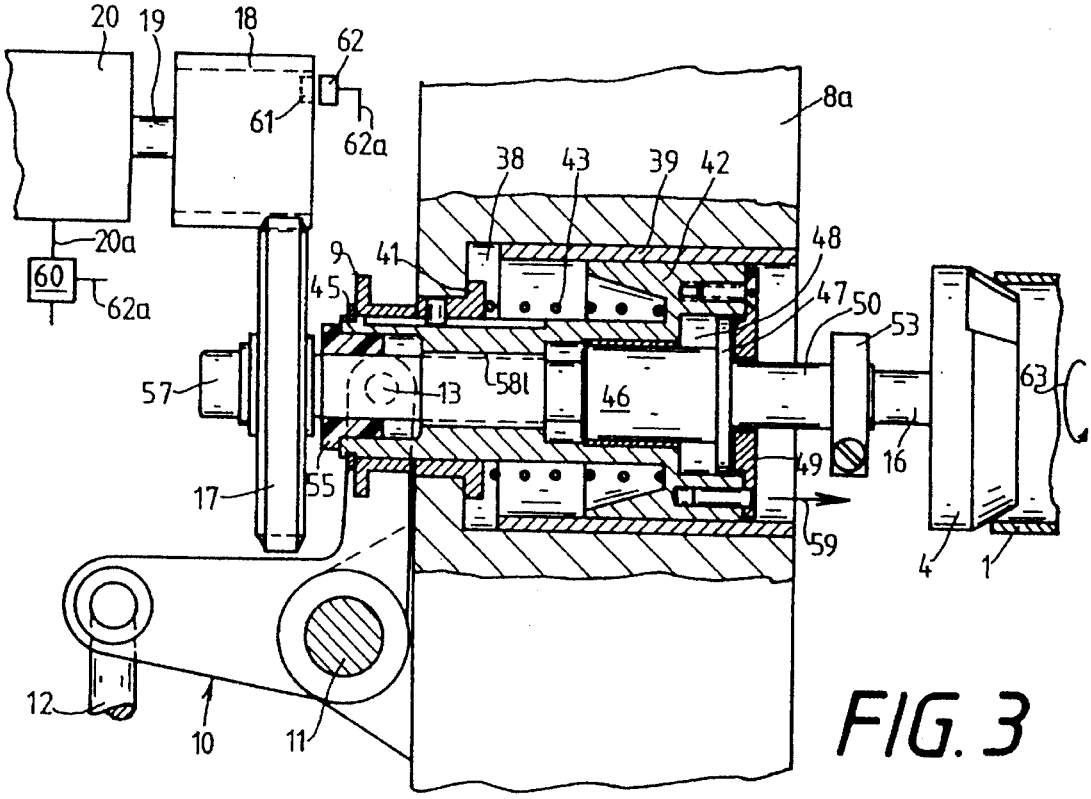
FIG. 3 is another cross-sectional view of the device of FIG. 1, similar to FIG. 2, showing the threaded spindle in the starting position for deposit of the yarn reserve on the right end of the tube.

In FIG. 3, the present device is in the starting position for depositing the yarn reserve windings. The connecting rod 12 has been released and the spindle nut 42 has been displaced in the direction of the arrow 59 by the biasing force of the compression spring 43. Along with this motion, the tube clamping plate 4 is displaced via the threaded spindle 46 rightwardly in the direction of the arrow 59 into clamping engagement with the tube 1. Although not shown, it will be understood that the tube clamping plate 5 on the opposite side of the apparatus is released at the same time to also engage and clamp the other end of the tube 1. Thus the empty tube 1 is now held between the opposing tube clamping plates 4,5.

To deposit reserve windings of the yarn, the tube is displaced while the yarn is delivered by the stationary yarn guide 35. In the starting position the yarn extends generally parallel to the tube axis from the tube rim, where the yarn is clamped between the tube rim and the tube clamping plate, to the yarn guide. The starting position of the yarn guide is situated adjacent the front of the tube periphery, offset from the end of the tube by the width (i.e., axial dimension) of the reserve winding to be formed and by the spacing to remain between the reserve winding and the end of the tube. The appropriate starting position of the yarn guide for depositing the yarn reserve windings on the right end of the empty tube is indicated in the position shown in FIG. 1.

Once the tube 1 has been clamped between the tube clamping plates 4,5, the motor 20 is energized by means of a control device 60 via a control line 20*a*. The number of yarn windings which are to be deposited as reserve windings on the tube can be preset by means of the control device. The gradient or helix angle with which the windings are deposited on the tube is determined by the screw thread 58*l*. The distance by which the tube is displaced is determined by the lead of the screw thread 58*l* and the number of revolutions of the tube driven by the motor 20. A signal transmitter 61 is attached to the inward face of the pinion gear 18, so that the number of revolutions of the pinion gear 18 can be detected by an adjacent stationary sensor 62. The number of revolutions of the pinion gear 18 has a fixed relationship to the number of revolutions of the gear wheel 17. In this manner, it is possible to determine the number of revolutions of the gear wheel 17 and thus of the tube 1 by means of the detected number of revolutions of the pinion gear 18. The sensor 62 generates pulses based on the detections of the signal transmitter 61 and supplies the pulses to the control device 60 via a signal line 62*a*, so that the motor 20 can be deenergized after the required preset number of windings for the yarn reserve has been determined to have been applied based on the corresponding number of revolutions of the tube 1.

Figure 4:
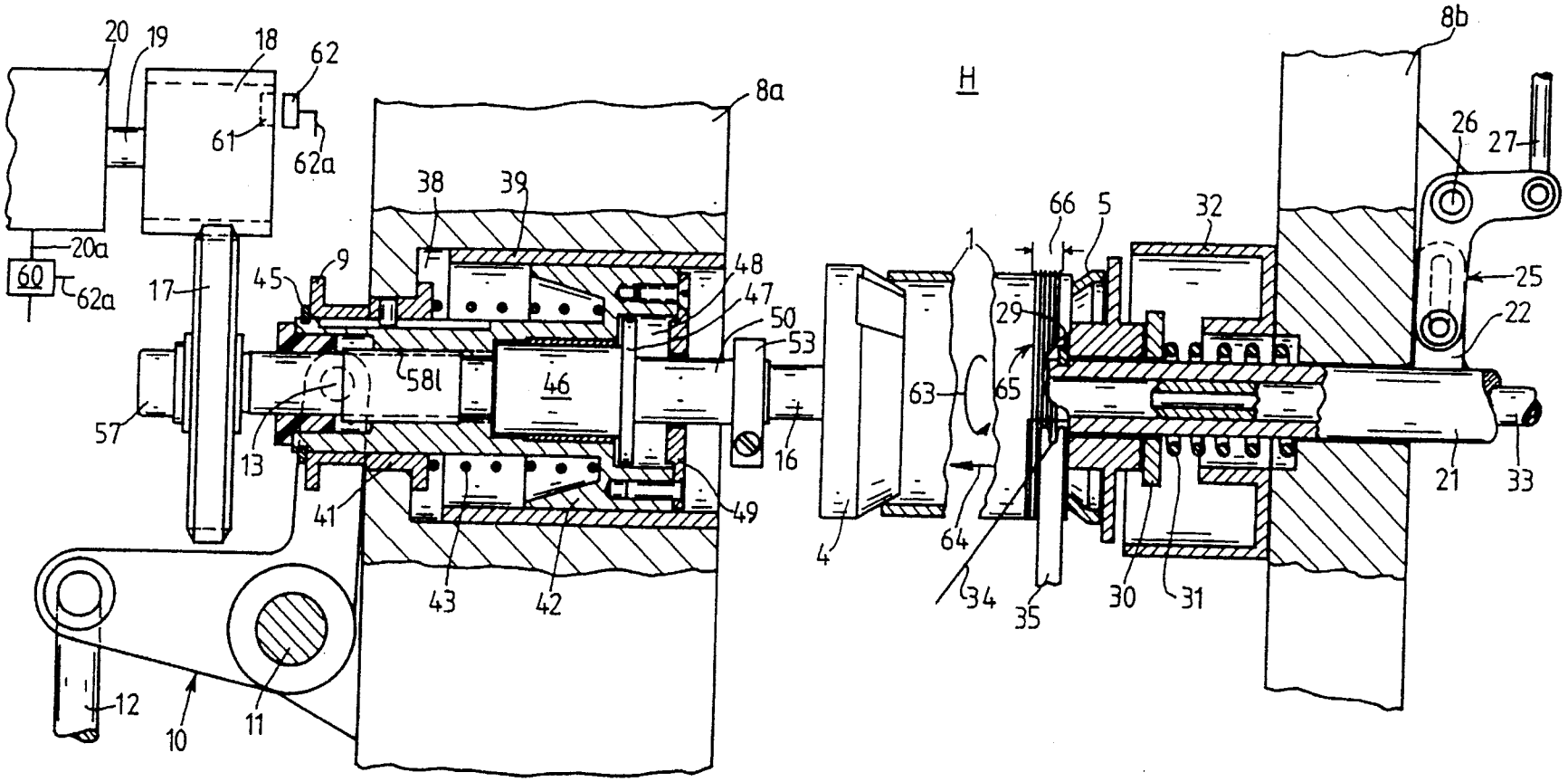
FIG. 4 another cross-sectional view of the device of FIG. 1, showing the threaded spindle in the ending position after deposit of the yarn reserve on the right end of the tube.

Thus, when the motor 20 is energized, the pinion gear 18 rotates for a preset number of revolutions and, in turn, the gear wheel 17 is driven. Since the spindle nut 42 is maintained stationarily in the recess 38 by the pin 44, the threaded spindle 46 rotates inside the spindle nut 42. As aforementioned, when the yarn reserve windings are to be deposited on the right end of the tube, the screw threads 58*l* of the spindle 46 and the nut 42 are left-hand screw threads, whereby the tube turns toward the viewer, as viewed in FIGS. 3 and 4 and as indicated therein by the arrow 63. In the course of such rotation, the tube is displaced with respect to the stationary yarn guide 35 toward the left in the direction of the arrow 64, as indicated in FIG. 4. The coil spring 31 retains a sufficient degree of compression with the tube 1 inserted and clamped between the plates 4,5. Thus, during the leftward displacement of the tube, the corresponding relaxation of the spring 31 retains the plate 5 in clamping contact with the tube 1 by acting against the ring 30 which in turn displaces the tube clamping plate 5 leftward on the connecting rod 21. Thus, the tube 1 does not fall from the tube clamping plates 4,5 during the movement of the threaded spindle 46 in the direction 64.

FIG. 4 shows the tube 1 with the completed wound yarn reserve 65 which, in the illustrated example, comprises five windings deposited on the tube over a width 66. Therefore, the tube 1 has been displaced by the distance 66 toward the left with respect to the yarn guide 35. In the course of this displacement, the collar 47 of the threaded spindle 46 moves from its starting position abutting the abutment disk 49 to the opposite leftward end of the recess 48. A defined ending position for the displacing movement of the threaded spindle 46 is thereby attained.

From this ending position, it is possible to exchange the tube 1 with the thusly formed foot windings, i.e., the yarn reserve 65. For this purpose, the tube 1 is re-grasped by the gripper 2. The actuators 10,25 are pivoted about their joints 11,26 by movement of the respective connecting rods 12,27 in the directions 14,27*a* as shown in FIG. 1 and the tube retaining plates 4,5 are retracted out of the tube. The tube is then inserted into a winding station (not shown) for winding a body of yarn onto the tube to form a yarn package in the form of a cheese or other yarn bobbin.

After the tube wound with the yarn reserve has been removed, the motor 20 is energized again via the control device 60 and is driven in the opposite direction to that during the deposit of the yarn reserve to rotate the threaded spindle 46 by as many revolutions as had been required for depositing the yarn reserve, thereby returning the threaded spindle 46 to its original starting position. The number of required revolutions is monitored by means of the sensor 62. After the threaded spindle 46 has been rotated back into the starting position, the device is ready for receiving a fresh empty tube.

If the yarn reserve is to be deposited on the left end of the tube, it is necessary to employ a threaded spindle 46 with a right-hand screw thread 58*r*. As will be understood, a right-hand screw thread 58 is required because, as aforementioned, the direction of rotation 63 of the tube for winding a yarn is fixed and the tube must be displaced from the left to the right in the direction of the arrow 67 (see FIG. 5) for depositing the yarn reserve on the left end of the tube.

To be able to deposit a yarn reserve on the left end of the cheese tube, the threaded spindle 46 with the spindle nut 42 as shown in FIG. 1 can be removed from the recess 48 in the holder element 8*a* by loosening the screw 57 and detaching the gear wheel 17 from the conical portion 56 of the threaded spindle 46. After loosening the locking ring 45, the thrust bushing 9 can be pulled off the threaded spindle 46. There-upon, the spindle nut 42 with the threaded spindle 46 can be pulled out of the slide bushing 39 rightwardly and can be exchanged for a threaded spindle and spindle nut with an opposite screw thread. After loosening the clamp 53, the shaft 16 of the tube retaining plate 4 can be pulled out of the tubular element 50 of the threaded spindle 46 and inserted into the threaded spindle with an opposite screw thread. The assembly of the shaft 16 with the new spindle and nut is inserted into the recess 48 in the holder element 8*a* and, after placing the thrust bushing 9 on the new spindle and securing it by means of the locking ring 45 and after reattaching the gear wheel 17, the conversion is completed.

The exchange of a spindle nut and threaded spindle with a different thread lead also takes place as described above. The thread lead determines the longitudinal displacement of the tube as a function of the direction of rotation.

Figure 5:
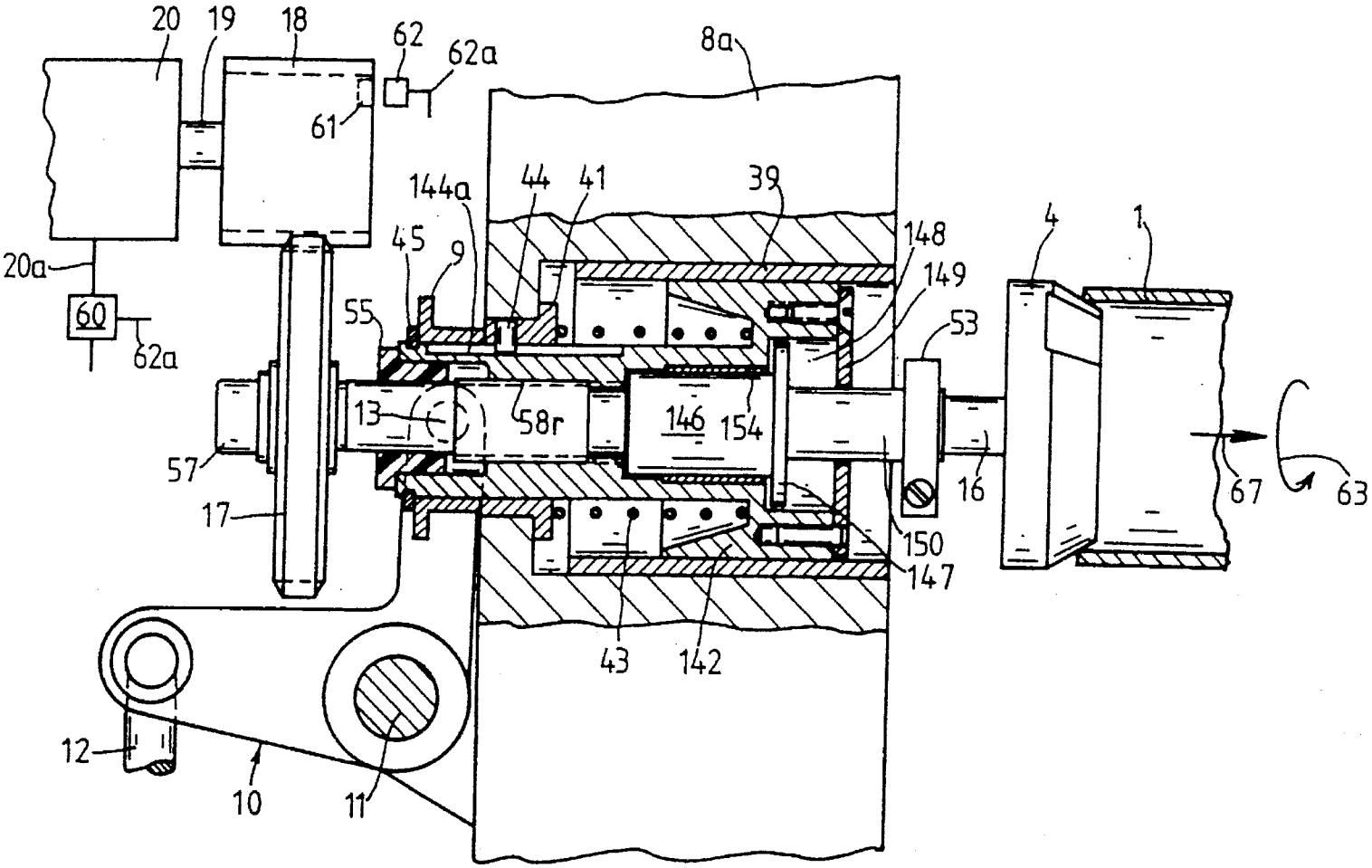
FIG. 5 is another cross-sectional view of the device of FIG. 1, showing the threaded spindle in the starting position for deposit of the yarn reserve on the left end of the tube.

FIG. 5 shows the device of FIG. 1 equipped with an oppositely threaded spindle and nut for depositing a yarn reserve on the left end of a tube. Components which correspond with the previously described set-up of this embodiment are provided with the same reference numerals. A spindle nut 142 and a threaded spindle 146 have been substituted for that of the device shown in FIGS. 1–4 and are of essentially the same construction as the spindle 46 and nut 42 except that their screw threads are right-hand screw threads 58*r*. The pin 44 slides in the groove 144 in the nut 142 to prevent rotation or twisting of the spindle nut 142 in the recess 38. The shaft 16 of the tube clamping plate 4 has been inserted into the tubular element 150 and clamped in place by means of the clamp 53. A tube 1 is inserted between and supported by the tube retaining plates 4,5 (the latter not shown). The threaded spindle 146 is shown in the starting position. In contrast to the set-up of FIGS. 1–4, the spindle 146 has been rotated for this purpose leftwardly to a sufficient extent that the collar portion 147 is disposed at the leftward end of the recess 148 representing the defined starting position. When the threaded spindle 146 is now rotated by the motor 20, the spindle 146 moves in the rightward direction 67 because of the prescribed direction of tube rotation 63 and the right-hand screw threads 58*r*. The abutment disk 149 serves as a stop to prevent the threaded spindle 146 from being driven out of the spindle nut 142. While rotating, the threaded spindle 146 is guided in the bushing 154 within the spindle nut 142.

Figure 6:
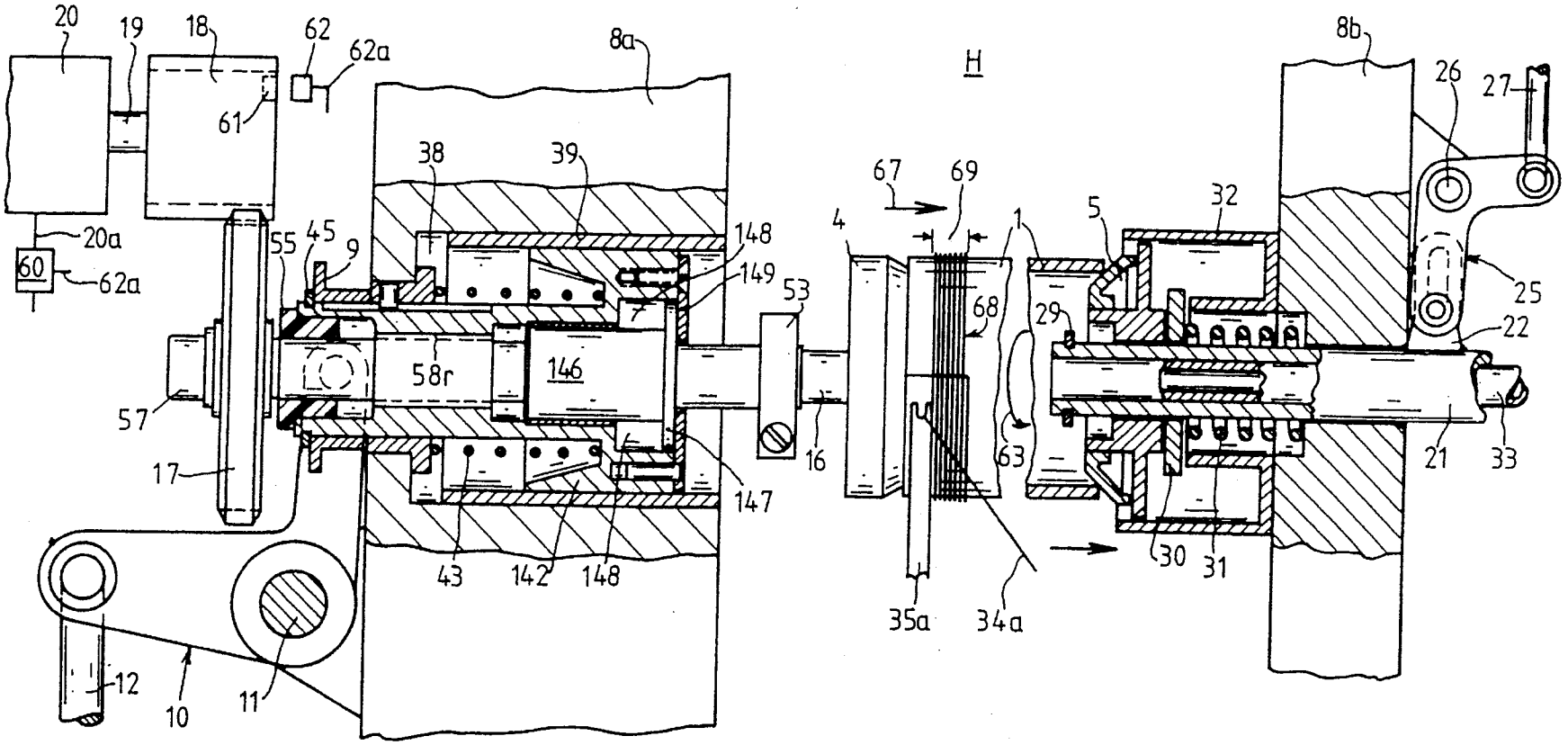
FIG. 6 is another cross-sectional view of the device of FIG. 1, showing the threaded spindle in the ending position after deposit of the yarn reserve on the left end of the tube.

To accomplish winding of the yarn reserve on the left end of the tube 1, the device must displace the tube 1 rightwardly from the starting position, illustrated in FIG. 5, into the ending position shown in FIG. 6. For this purpose, the control device 60 energizes the motor 20 via the control line 20*a* to rotate the pinion gear 18 for a sufficient number of revolutions to accomplish placement of the desired number of yarn windings on the left end of the tube 1 by its displacement in the rightward direction 67.

FIG. 6 shows the ending position of the tube 1 after the yarn reserve has been wound on its left end. To deposit the yarn reserve beginning in the starting position of FIG. 5, the threaded spindle 146 is rotated within the spindle nut 142 until the collar 147 is located at the leftward end of the recess 148. In accordance with FIG. 1, the yarn guide 35*a* remains in the position shown, while the yarn 34*a* is being fed in during winding of the yarn reserve. To deposit the yarn reserve 68 (FIG. 6) comprising five yarn windings, the tube 1 is displaced rightwardly by the distance 69 in the direction 67 by rotation of the threaded spindle 146 within the spindle nut 142 until the collar portion 147 abuts the abutment disk 149.

During the displacement of the tube 1 by the axial dimension 69 of the yarn reserve 68, the tube clamping plate 5 acts against the biasing force of the spring 31 in the holder element 8*b*. After deposit of the yarn reserve 68 on the tube 1, which is then in the position shown in FIG. 6, and after subsequent separation of the tube clamping plates 4,5 by means of the actuators 10,26, the tube is grasped by the gripper 2 (not shown) and is removed from the device. After removing the tube 1 with the yarn reserve 68, the tube clamping plate 4 is retracted back into its starting position by driving the pinion gear 18 in the opposite direction from that during depositing of the yarn reserve. The number of revolutions corresponds to the number of revolutions that were selected for depositing the yarn reserve. The direction of rotation and the number of revolutions are controlled by means of the sensor 62.

Figure 7:
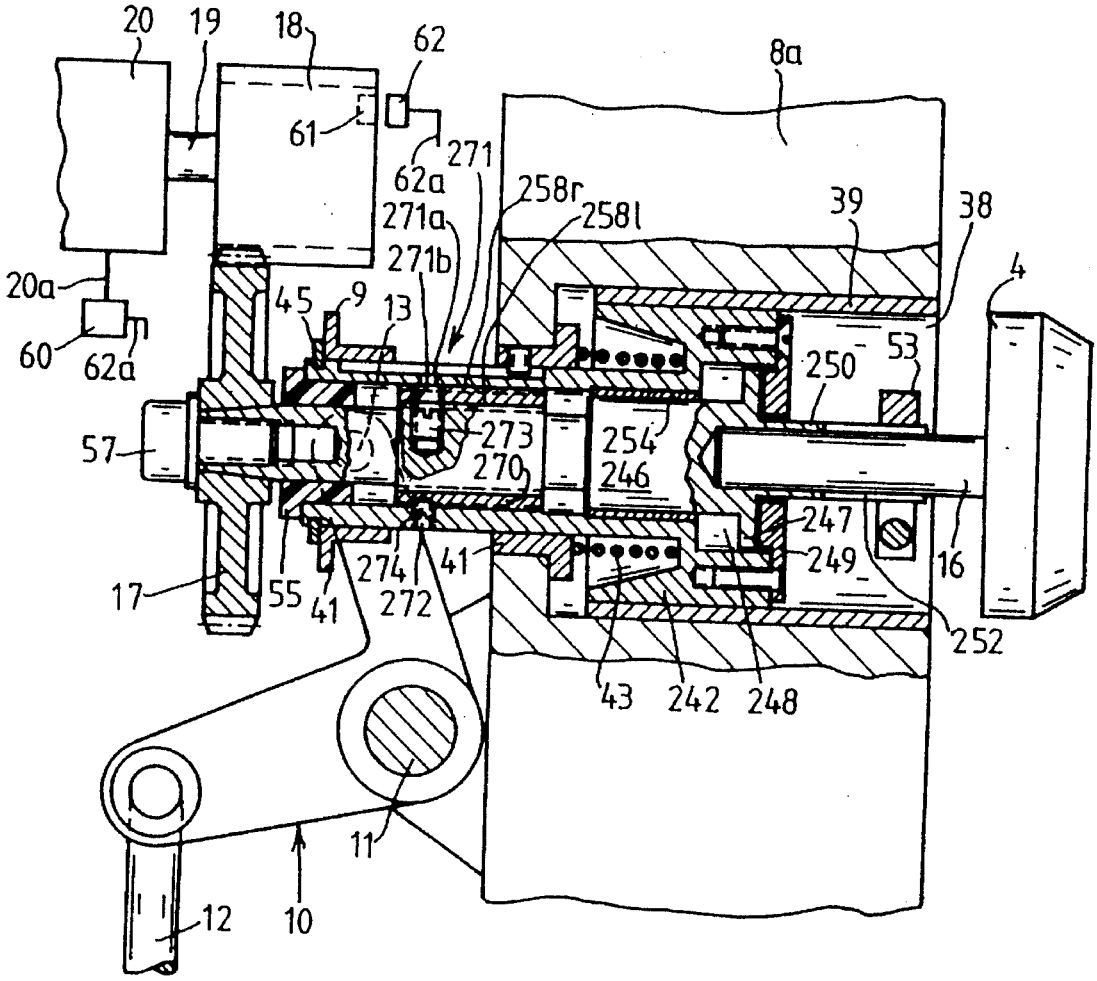
FIG. 7 is a cross-section taken through an alternate embodiment of the device of the present invention, wherein the threaded spindle is seated in a threaded bushing for deposit of the yarn reserve windings on the right as well as the left ends of a tube, the spindle being shown to be retracted for inserting a tube.
Figure 8:
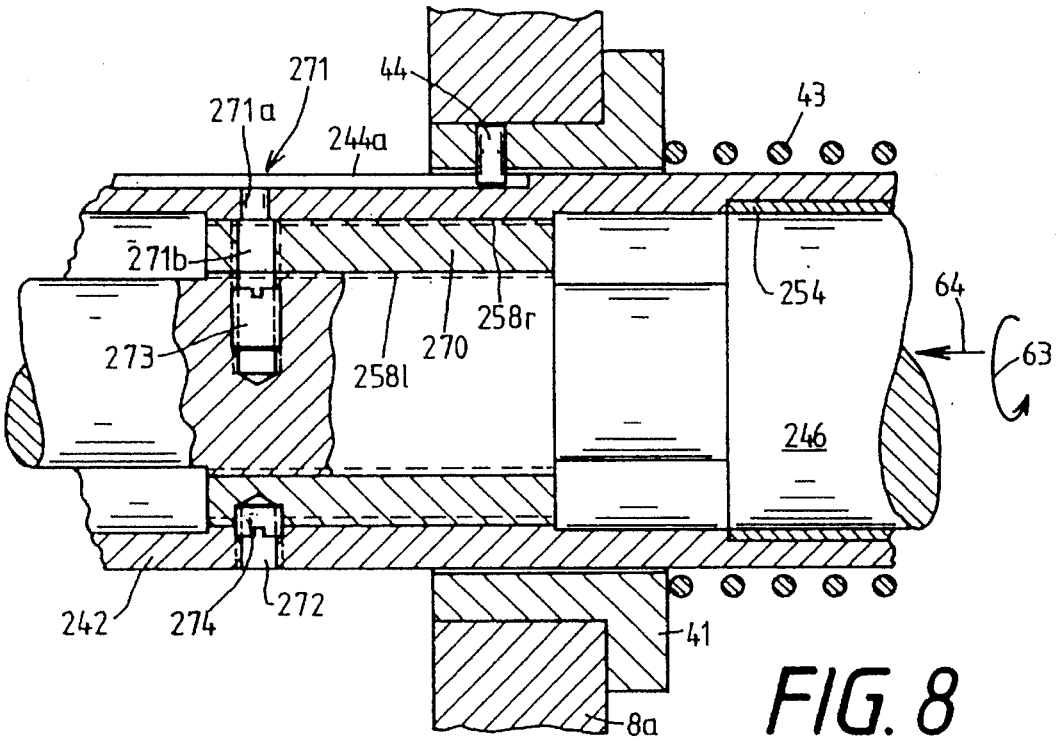
FIG. 8 is another cross-section similar to FIG. 7, showing the threaded bushing fixedly connected with the spindle nut for deposit of the yarn reserve on the right end of the tube.
Figure 9:
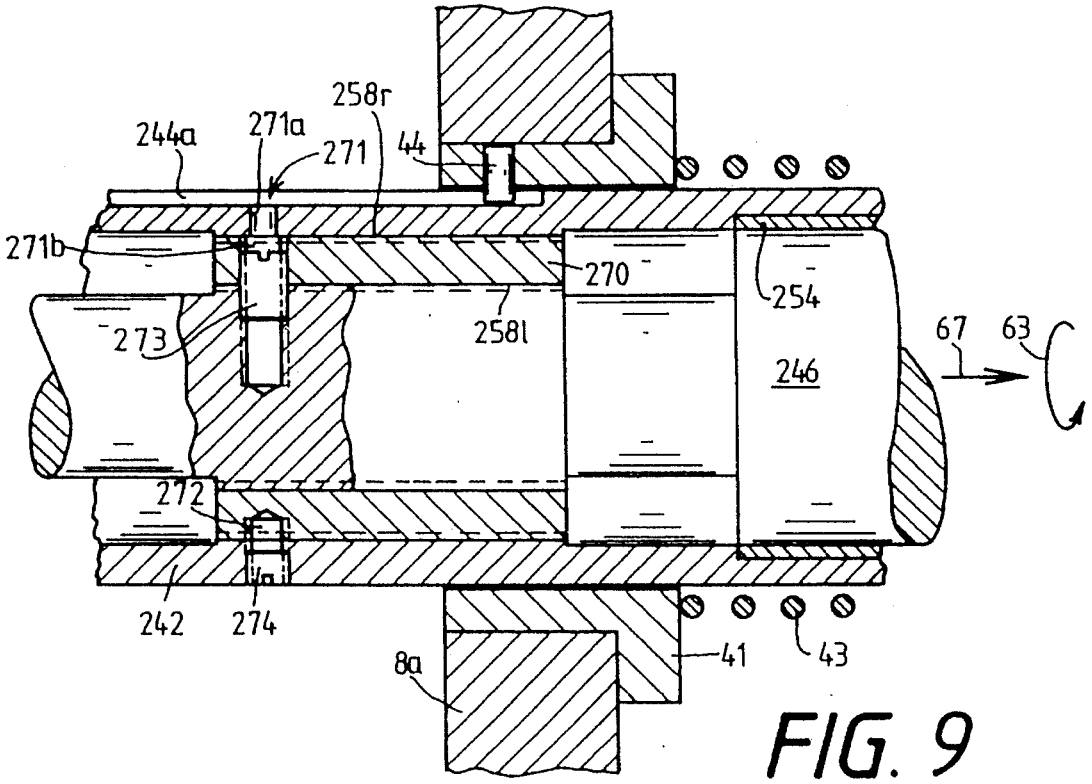
FIG. 9 is another cross-section similar to FIG. 7, showing the threaded bushing fixedly connected with the threaded spindle for deposit of the yarn reserve on the left end of the tube.

FIG. 7 shows another embodiment of the invention and FIGS. 8 and 9 show this embodiment on an enlarged scale. Except for the design of the threaded spindle 246 and the spindle nut 242, the embodiment of the device in accordance with FIG. 7 corresponds with the device as illustrated in FIGS. 1–6.

In FIG. 7–9, the spindle nut 242 is glided in the slide bushing 39 in the recess 38 of the holder element 8*a*. However, the threaded spindle 246 is not in direct threaded engagement with the spindle nut 242. Instead, a threaded bushing 270 is disposed between the spindle nut 242 and the threaded spindle 246. The threaded bushing 270 is of a relatively thin cross-section and has a left-hand screw thread 258*l* on its interior and a right-hand screw thread 258*r* on its exterior circumference. A reversed arrangement of the threads in respect to the direction of their turns is also possible. The threaded spindle 246 is threadedly engaged in the threaded bushing 270 by mating left-hand screw threads 258*l* , while in turn the threaded bushing 270 is threadedly engaged within the spindle nut 242 by mating right-hand screw threads 258*r*. The remaining characteristics of the threaded spindle and the spindle nut in this embodiment agree with the devices of the preceding drawing figures. The head portion of the threaded spindle 246 supports the shaft 16 of the tube clamping plate 4 in the tubular element 250 with the clamp 53 placed over the clamping slit 252 in order to fix the shaft 16 in the tubular element 250. The collar portion 247 of the threaded spindle 246 moves between the abutment disk 249 and the opposite leftward end of the recess 248 within the head portion of the spindle nut 242. When rotating, the threaded spindle 246 glides in the bushing 254 within the head portion of the spindle nut 242.

Two bores 271,272 are formed in the tube-shaped portion of the spindle nut 242 which extends leftwardly through the glide bushing 41 and outwardly from the wall of the holder element 8*a*. The bore 271 extends through the bushing 270 into the spindle nut 246, with the portions 271*b* of the bore 271 in the threaded bushing 270 and in the threaded spindle 246 having a larger diameter than the bore portion 271*a* in the tube-shaped part of the spindle nut 242. In addition, the bore portions 271*b* have a screw thread, so that a set screw 273 can be inserted into the threaded bushing 270 as well as into the threaded spindle 246. The bore portion 271*a* is only large enough for a screwdriver to reach the set screw 273. The set screw 273 is of a size that it can be screwed completely into the portion 271*b* of the bore 271 within threaded spindle 246. When being unscrewed from the threaded spindle 246, the set screw 273 cannot be completely withdrawn because of the smaller diameter of the bore 271*a*. By being screwed into a disposition overlapping the bore portions 271*b*, the set screw 273 connects the threaded bushing 270 with the threaded spindle 246 for unitary rotation.

The bore 272 extends through the spindle nut 242 into the threaded bushing 270 and is formed with a screw thread in which a set screw 274 is threadedly seated. The set screw 272 is of a sufficient length that, when completely screwed into the bore 272, the set screw 272 connects the threaded bushing 270 with the spindle nut 242 for unitary rotation, but when this set screw 274 is withdrawn until it appears on the surface of the spindle nut 242, the threaded bushing 270 is released for rotation independently of the spindle nut 242.

The bores 271,272 become accessible when the spindle nut has been pulled out of the holder element 8*a* toward the left by operating the actuator 10, as depicted in FIG. 7. FIGS. 8 and 9 respectively show in enlargement the portions of the spindle nut 242 and the threaded spindle 246 in which the threaded bushing 270 is disposed.

The left-hand screw threads 258*l* are freed for relative rotation between the spindle 246 and the bushing 270 by positioning the set screw 273 to release the threaded bushing 270 with respect to the threaded spindle 246 and positioning the set screw 274 to connect the threaded bushing 270 with the spindle nut 242. The right-hand screw thread 258*r* becomes usable for relative rotation between the bushing 270 and the spindle nut 242 when the threaded spindle 246 is connected with the threaded bushing 270 by the set screw 273 and the threaded bushing 270 is released from the spindle nut 242 by the set screw 274. By means of alternate release and connection of the threaded bushing either with the threaded spindle or with the threaded bushing it becomes possible to wind a yarn reserve on the right or left end of a tube without having to replace the threaded spindle and the spindle nut.

FIG. 8 shows the setting of the threaded bushing 270 for depositing a yarn reserve on the right side of the tube, corresponding to the exemplary embodiment of FIGS. 1–4. A left-hand screw thread is necessary to deposit a yarn reserve on the right tube end, while maintaining the direction of rotation 63 of the tube 1 and displacing the tube toward the left in the direction of the arrow 64. In this case it is necessary to release the left-hand screw thread 258*l* between the threaded bushing 270 and the threaded spindle 246. For this purpose, the set screw 273 is screwed sufficiently into the threaded spindle 246 until it releases the threaded bushing 270, as is illustrated in FIG. 8.

To enable the threaded spindle 246 to be displaced in relation to the spindle nut 242, the spindle nut 242 must be connected with the threaded bushing 270, whereby their right-hand screw threads 258*r* are blocked against relative rotation. The connection between the bushing 270 and the spindle nut 242 is made by advancing the set screw 274 in the threaded bore 272 inwardly until the set screw 274 spans and thereby connects the threaded bushing 270 with the spindle nut 242. The bore 272 is formed sufficiently into the threaded bushing 270 that it terminates therein as a blind bore. Screwing the set screw 274 inwardly until it is stopped properly locates the screw 274 to achieve a secure connection of the threaded bushing 270 with the spindle nut 242, whereby their right-hand threads are blocked. As a result, the threaded spindle 246 can only move in relation to the spindle nut 242 by means of the mating left-hand screw threads 258*l* between the spindle 246 and the bushing 270.

The conversion from the left-hand screw threads 258*l* to the right-hand screw threads 258*r* is illustrated in FIG. 9. To deposit a yarn reserve on the left end of the tube, the displacement of the tube 1 in the rightward direction of the arrow 67 is necessary. Since the direction of tube rotation 63 for winding a yarn reserve is the same for deposit on the left and right ends of the tube, it is necessary to select a right-hand screw thread for depositing the yarn reserve on the left end.

In this case it is necessary to withdraw the set screw 273 in the threaded bore 271 outwardly from the threaded spindle 246 until the set screw 273 spans the bore 271*b* within both the threaded bushing 270 and the spindle 246. However, the set screw 273 must not be withdrawn so far that it comes to rest against the spindle nut 242. The threaded bushing 270 must still be able to turn freely by its screw thread 258*r*. The right-hand screw thread 258*r* is released by withdrawing the set screw 274 out of the threaded bore 272 sufficiently that it becomes visible at the surface of the spindle nut 242 and is thereby withdrawn from the threaded bushing 270. However, it must not be withdrawn far enough that it protrudes from the bore 272 and hampers the sliding of the spindle nut 242 inside the bushing 41 of the holder element 8*a* . As a result, when the threaded spindle 246 is rotated in the direction of tube rotation 63 toward the viewer, as seen in FIG. 9, the spindle 246 and the bushing 270 rotate as a unit relative to the spindle nut 242 in the rightward direction of the arrow 67 due to the mating right-hand screw threads between the bushing 270 and the spindle nut 242.

Thus, the embodiment of the invention illustrated in FIGS. 7–9 makes it possible to deposit reserve yarn windings in the form of foot windings on the right as well as the left ends of a tube with one and the same device, without having to remove the spindle nut and the threaded spindle.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. An apparatus for automatically forming windings of a leading end of a yarn to form a yarn reserve on an end of an empty tube prior to winding a main body of the yarn about a central extent of the tube to form a yarn package, comprising means for holding the tube with respect to the yarn to be wound, the tube holding means including means for selectively displacing the tube longitudinally in opposing directions for selectively placing the yarn reserve windings on either end of the tube during rotation of the tube in a fixed direction of rotation, said displacing means comprising a pair of tube clamping plates, a spring for biasing one of the tube clamping plates toward the other, a threaded spindle device supporting the other tube clamping plate, a spindle nut disposed annularly about the spindle device, and a holder element supporting the spindle nut, wherein the thread direction of the spindle device determines the longitudinal direction of displacement of the tube for depositing the yarn reserve windings.

2. An apparatus in accordance with claim 1, wherein the spindle nut is exchangeably disposed in the holder element.

3. An apparatus in accordance with claim 1, wherein the tube wherein the tube holding means comprises first and second assemblies each including one said threaded spindle device and one said spindle nut matingly threaded therewith, the first and second assemblies being interchangeably mountable to the holder element changing the direction of tube displacement, the spindle device and nut of the first assembly having mating threads of a first thread direction and the spindle device and nut of the second assembly having mating threads of an opposite thread direction.

4. An apparatus in accordance with claim 1, wherein the threaded spindle device comprises a bushing formed with interior and exterior threads, a threaded spindle extending interiorly through the bushing in mating threaded engagement with its interior threads, and the spindle nut being disposed about the bushing in mating threaded engagement with its exterior threads, the mating threads of the spindle and the interior of the bushing having an opposite thread direction from the mating threads of the exterior of the bushing and the spindle nut, and means for selectively fixing the spindle and the bushing for unitary threaded rotation relative to the spindle nut and selectively fixing the spindle nut and the bushing for unitary threaded rotation relative to the spindle.

5. An apparatus in accordance with claim 1, wherein the spindle nut and the threaded spindle device are exchangeably disposed in the device for holding the tube.

6. An apparatus in accordance with claim 1, wherein the spindle nut is displaceably seated in the holder element for movement of the associated tube clamping plate for exchanging a tube.

7. An apparatus for automatically forming windings of a leading end of a yarn to form a yarn reserve on an end of an empty tube prior to winding a main body of the yarn about a central extent of the tube to form a yarn package, comprising means for holding the tube with respect to the yarn to be wound, the tube holding means including means for selectively displacing the tube longitudinally in opposing directions for selectively placing the yarn reserve windings on either end of the tube during rotation of the tube in a fixed direction of rotation, said displacing means comprising a pair of tube clamping plates, a spring for biasing one of the tube clamping plates toward the other, a threaded spindle device supporting the other tube clamping plate, a spindle nut disposed annularly about the spindle device, and a holder element supporting the spindle nut, wherein the spindle nut is exchangeably disposed in the holder element.

8. An apparatus for automatically forming windings of a leading end of a yarn to form a yarn reserve on an end of an empty tube prior to winding a main body of the yarn about a central extent of the tube to form a yarn package, comprising means for holding the tube with respect to the yarn to be wound, the tube holding means including means for selectively displacing the tube longitudinally in opposing directions for selectively placing the yarn reserve windings on either end of the the tube during rotation of the tube in a fixed direction of rotation, said displacing means comprising a pair of tube clamping plates, a spring for biasing one of the tube clamping plates toward the other, a threaded spindle device supporting the other tube clamping plate, a spindle nut disposed annularly about the spindle device, and a holder element supporting the spindle nut, wherein the tube holding means further comprises first and second assemblies each including one said threaded spindle device and one said spindle nut matingly threaded therewith, the first and second assemblies being interchangeably mountable to the holder element for changing the direction of tube displacement, the spindle device and nut of the first assembly having mating threads of a first thread direction and the spindle device and nut of the second assembly having mating threads of an opposite thread direction.

9. An apparatus for automatically forming windings of a leading end of a yarn to form a yarn reserve on an end of an empty tube prior to winding a main body of the yarn about a central extent of the tube to form a yarn package, comprising means for holding the tube with respect to the yarn to be wound, the tube holding means including means for selectively displacing the tube longitudinally in opposing directions for selectively placing the yarn reserve windings on either end of the tube during rotation of the tube in a fixed direction of rotation, wherein the tube holding means comprises a threaded spindle device comprises a bushing formed with interior and exterior threads, a threaded spindle extending interiorly through the bushing in mating threaded engagement with its interior threads, and a spindle nut disposed about the bushing in mating threaded engagement with its exterior threads, the mating threads of the spindle and the interior of the bushing having an opposite thread direction from the mating threads of the exterior of the bushing and the spindle nut, and means for selectively fixing the spindle and the bushing for unitary threaded rotation relative to the spindle nut and selectively fixing the spindle nut and the bushing for unitary threaded rotation relative to the spindle.

10. An apparatus fur automatically forming windings of a leading end of a yarn to form a yarn reserve on an end of an empty tube prior to winding a main body of the yarn about a central extent of the tube to form a yarn package, comprising means for holding the tube with respect to the yarn to be wound, the tube holding means including means for selectively displacing the tube longitudinally in opposing directions for selectively placing the yarn reserve windings on either end of the tube during rotation of the tube in a fixed direction of rotation, said displacing means comprising a pair of tube clamping plates, a spring for biasing one of the tube clamping plates toward the other, a threaded spindle device suppporting the other tube clamping plate, a spindle nut disposed annularly about the spindle device, and a holder element supporting the spindle nut, wherein the spindle nut and the threaded spindle device are exchangeably disposed in the device for holding the tube.

11. An apparatus for automatically forming windings of a leading end of a yarn to form a yarn reserve on an end of an empty tube prior to winding a main body of the yarn about a central extent of the tube to form a yarn package, comprising means for holding the tube with respect to the yarn to be wound, the tube holding means it including means for selectively displacing the tube longitudinally in opposing directions for selectively placing the yarn reserve windings on either end of the tube during rotation of the tube in a fixed direction of rotation, said displacing means comprising a pair of tube clamping plates, a spring for biasing one of the tube clamping plates toward the other, a threaded spindle device supporting the other tube clamping plate, a spindle nut disposed annularly about the spindle device, and a holder element supporting the spindle nut, wherein the spindle nut is displaceably seated in the holder element for movement of the associated tube clamping plate for exchanging a tube.

* * * * *